United States Patent [19]

Figura

[11] 4,179,053

[45] Dec. 18, 1979

[54] AWNING FOR BACK PACK

[76] Inventor: Gene B. Figura, 1502 Linden Dr., Ames, Iowa 50010

[21] Appl. No.: 872,507

[22] Filed: Jan. 26, 1978

[51] Int. Cl.[2] ..... A45B 11/02

[52] U.S. Cl. ..... 224/190; 135/5 C; 224/213

[58] Field of Search ..... 224/25 A, 5.1, 8 R, 224/9, 25 R; 135/5 C, 5 D, DIG. 5, DIG. 7; 248/206 A, 147

[56] References Cited

U.S. PATENT DOCUMENTS

| | | | |
|---|---|---|---|
| 288,115 | 11/1883 | Ray | 135/5 C |
| 903,682 | 11/1908 | Cumpston | 224/5.1 |
| 1,378,031 | 5/1921 | Hinton | 135/5 D |
| 3,292,795 | 12/1966 | Chappell | 248/147 X |
| 3,361,404 | 1/1968 | Lohr | 248/206 A |
| 3,840,161 | 10/1974 | Boggs et al. | 224/25 A X |

*Primary Examiner*—Jerold M. Forsberg
*Attorney, Agent, or Firm*—Zarley, McKee, Thomte, Voorhees & Sease

[57] ABSTRACT

A collapsible awning for use with a back pack is disclosed which comprises a frame having opposite side rod members detachably secured to a back pack frame by clamps and a front member detachably secured to the side members and extending therebetween. The clamps are pivotally mounted to the pack frame and detachably secure the awning frame to the back pack frame such that the awning frame is securely maintained in a generally horizontal position above the head of the back pack wearer. The pivotal mounting the clamp allows the awning to be pivoted upward to aid in initially putting on the back pack. Magnetic catches hold the clamps from random pivotal motion when the awning is not being used. An elastic shock absorbing member extends from the side frame member to the back pack frame to aid the clamps in maintaining the position of the awning frame during use in windy weather. A canopy member of pliable material capable of protecting the back pack wearer from sunlight and rain extends between the opposite side members and is maintained in a generally concave configuration relative to the wearer by an arcuate shaped stiffener element also extending between the opposite side members. The awning is collapsible by releasing the side rod members from the clamps, detaching the shock absorbing member from the back pack frame, detaching the front awning frame member from the opposite side frame members, and rolling up the side members and canopy to form a compact package for transporting in the back pack when not in use.

1 Claim, 3 Drawing Figures

AWNING FOR BACK PACK

BACKGROUND OF THE INVENTION

This invention relates to an awning device, and more particularly to a collapsible awning device for use in combination with a back pack. Prior awning devices are not adaptable for use with a back pack and do not provide the light weight, collapsible compact features necessary for backpacking.

SUMMARY OF THE INVENTION

A collapsible awning for use with a back pack is disclosed which comprises a frame having opposite side members detachably secured to a back pack frame by clamps and a front member detachably secured to the side members and extending therefrom. The clamps are pivotally mounted to the back pack frame and detachably secure the awning frame to the back pack frame and maintain the frame in a generally horizontal position above the head of the back pack wearer with the aid of an elastic shock absorbing member extending from the side awning frame member to the back pack frame. The shock absorbing member provides support to the awning frame and aids in maintaining the position of the awning frame during windy weather. The pivotal mounting of the clamps allow the awning to be pivoted upward to aid in initially putting on the back pack. Magnetic catches hold the clamps against the pack frame when the awning is not being used. A canopy member of pliable material capable of providing insulation from sunlight and rain extends between the side members of the awning frame and is maintained in a generally concave shape relative to the back pack wearer by an arcuate shaped stiffener element also extending between the side members. The awning is collapsible by detaching the awning frame and shock absorbing member from the back pack frame, detaching the front member from the opposite side members, and rolling up the side members and canopy together to form a compact package for storage in a back pack.

An object of this invention is to provide an awning for use with a back pack that provides protection against sunlight and rain.

A further object of the invention is to provide a light weight collapsible awning for use with a back pack.

A still further object of the invention is to provide an awning for use with a back pack that rolls up into a compact package that occupies very little space in a back pack during travel.

A still further object of the invention is to provide an awning for use with a back pack that is economical to manufacture, durable in use and refined in appearance.

DESCRIPTION OF THE PREFERRED EMBODIMENT

Figure 2:
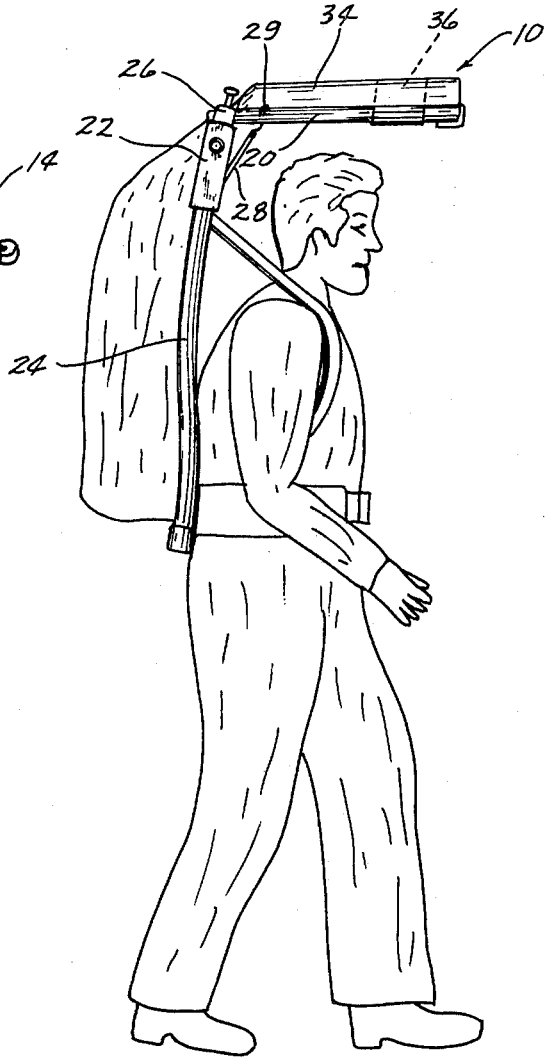
FIG. 2 is a side view of a person wearing the back pack with the invention attached.

The collapsible awning of this invention is generally referred to by the reference numeral 10 and is shown in FIG. 2 attached to a conventional back pack 12.

Figure 1:
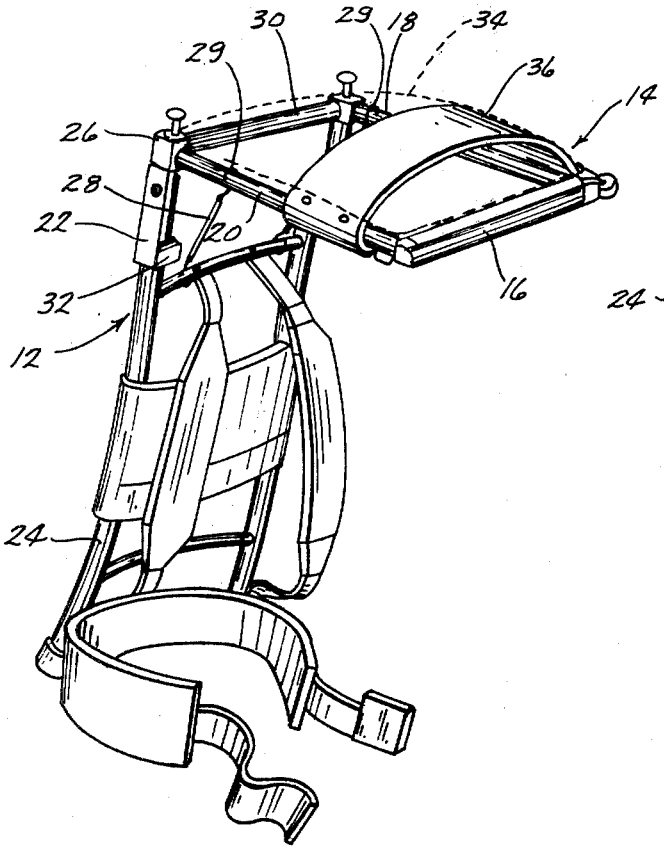
FIG. 1 is a perspective view of the invention mounted to a conventional back pack frame.
Figure 3:
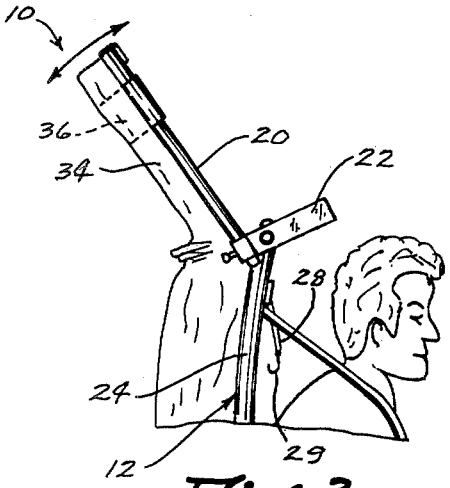
FIG. 3 is a side view similar to FIG. 2 with the awning in a raised position.

The frame 14 of awning 10 comprises a front member 16 detachably secured to opposite side rod members 18 and 20 as shown in FIG. 1. Brackets 22 are pivotally attached to back pack frame 24. Awning clamps 26 are securely attached to brackets 22 and detachably receive side members 18 and 20 to form a rectangular frame. Shock cord restrainers 28 are detachably attached at one end to side rod members 18 and 20 by hooks 29 and are detachably attached at the other end to pack frame 24 by hooks 29 as shown in FIG. 1. Bracket 22 and awning clamp 26 detachably secure awning frame 14 to back pack frame 24 in a generally horizontal disposition above the head of the back pack wearer, as illustrated in FIG. 2. The shock cord restrainers 28 aid in maintaining the position of awning frame 14, and provide stability against jolting movements when used in rugged terrain and windy weather. The pivotal connection of bracket 22 to back pack frame 24 allows awning 10 to be pivoted upwardly as shown in FIG. 3 to aid in initially putting on and removing the back pack. Stopper tabs with magnets 32 hold brackets 22 against pack frame 24 when the pack is being used with and without awning 10.

Canopy 34 is made of pliable material and extends between side member 18 and side member 20 to provide overhead protection against sunlight and rain to a back pack wearer, as illustrated in FIG. 2. Canopy 34 is attached at one end to side member 20 and at the other end to side member 18. A concave disposition of canopy 34 relative to the head of a back pack wearer to facilitate the running off of rain water is obtained by arcuate stiffener member 36 supporting the underside of canopy 34. Arcuate stiffener member 36 is attached to side members 18 and 20 and extends therebetween to provide the concave shape to the pliable material of canopy 34. Member 36 is constructed of thermal insultating material to provide further insulation from the sun.

In use, awning 10 provides protection to the back pack wearer against sunlight and inclement weather. When such protection is not desired, awning 10 is easily removed and conveniently stored in back pack 12 by detaching shock cords 28, detaching side member 18 and 20 from awning clamps 26, detaching front member 16 from side members 18 and 20, and together rolling up canopy 34, side members 18 and 20, and stiffener member 36 to form a compact package for storage in the back pack.

Thus, it can be seen that the invention accomplishes at least all of its stated objectives.

What is claimed is:

1. In combination, a back pack having a first frame means, and an awning comprising, a second support frame means including opposite, spaced apart side members, said side members being detachably secured at one end to said first frame means, a canopy member attached to and extended between said side members, said canopy member comprising a pliable material capable of providing insulation from sunlight and rain, said side members and canopy being capable of being rolled together into a compact shape upon detachment of said side members from said first frame means, means for detachably securing said side members to said first frame means such that said canopy member resides above and extends over the head of the wearer of said back pack, and a stiffener element connected to and extended between said side members, said stiffener element having a raised center portion to maintain said canopy member in a concave disposition relative to said wearer's head to facilitate rain water run off from said canopy member, and an elastic shock absorbing member having first and second ends extending between said second frame means and said first frame means to provide support to said second frame means and to maintain said second frame means in a generally horizontal plane above said wearer's head, said first end being detachably secured to said second frame means and said second end being detachably secured to said first frame means, said means for detachably securing said second frame means to said first frame means comprising at least one clamp detachably receiving one of said side members, said clamp being pivotally attached to said first frame means for pivotal movement between a first position wherein said second frame means is supported forwardly of and in a relatively perpendicular disposition to said first frame means and a second position wherein said second frame means is supported rearwardly of said first frame means, said clamp including stop means for limiting pivotal movement of said clamp to said first and second positions.

* * * * *